175-50

3/17/87 XR 4,649,993

SR

United States Patent [19]

Going, III

[11] Patent Number: 4,649,993

[45] Date of Patent: Mar. 17, 1987

[54] COMBINATION ELECTRICALLY OPERATED SOLENOID SAFETY VALVE AND MEASURING SENSOR

[75] Inventor: Walter S. Going, III, Houston, Tex.

[73] Assignee: Camco, Incorporated, Houston, Tex.

[21] Appl. No.: 776,065

[22] Filed: Sep. 18, 1985

[51] Int. Cl.[4] ..... E21B 34/16; E21B 47/06

[52] U.S. Cl. ..... 166/65.1; 166/66.4; 175/50; 251/129.21

[58] Field of Search ..... 166/53, 64, 65.1, 66.4, 166/66.5, 250; 175/48, 50; 251/129.2, 129.21

[56] References Cited

U.S. PATENT DOCUMENTS

| | | | |
|---|---|---|---|
| 3,692,106 | 9/1972 | Basham et al. | 166/64 |
| 3,930,220 | 12/1975 | Shawhan | 175/50 |
| 4,161,215 | 7/1979 | Bourne, Jr. et al. | 166/66.4 |
| 4,191,248 | 3/1980 | Huebsch et al. | 166/66.4 |
| 4,284,943 | 8/1981 | Rowe | 166/53 |
| 4,355,365 | 10/1982 | McCracken et al. | 166/64 |
| 4,520,468 | 5/1985 | Scherbatskoy | 175/50 |

*Primary Examiner*—James A. Leppink
*Assistant Examiner*—Terry Lee Melius
*Attorney, Agent, or Firm*—Fulbright & Jaworski

[57] ABSTRACT

A surface controlled electrically operated solenoid subsurface safety valve is positioned in a well tubing in a well and controlled by an electrical control line extending from the solenoid coil to the well surface. One or more measuring sensors are positioned in the well for measuring a physical property of the well. The input of the sensor is connected to the control line for receiving electrical power and the output of the sensor is connected to the control power for supplying an output signal proportional to the measurement of the physical property. The output signal is distinguishable from the electrical supply current to the solenoid coil. A signal processor at the well surface receives the sensor output. Preferably the sensors are connected in parallel with at least a portion of the solenoid coil.

9 Claims, 2 Drawing Figures

COMBINATION ELECTRICALLY OPERATED SOLENOID SAFETY VALVE AND MEASURING SENSOR

BACKGROUND OF THE INVENTION

It is known, as disclosed in my copending patent application Ser. No. 06/697,544, filed Feb. 1, 1985, to provide a subsurface electrically operated solenoid safety valve which utilizes a high current electrical supply to energize the solenoid coil to open the safety valve and thereafter utilizes a lower continuous current level to retain the safety valve in the open position. It is also conventional to utilize various types of measuring sensors in a well for measuring physical properties in the well such as pressure and temperature.

The present invention is directed to utilizing a single electrical control circuit extending from the well surface outside of the well tubing for operating an electric solenoid safety valve and one or more sensors. It is important to limit the number of control lines extending into an oil and/or gas well as the safety valve and sensors may be hundreds and even thousands of feet in the well. This combination limits the cost of the equipment, the complexity of installation, and possible damage to the control lines and equipment.

SUMMARY

The present invention is directed to the combination of a subsurface electrically operated solenoid safety valve and measuring sensor wherein an electrical solenoid coil of a subsurface safety valve is connected about a well tubing joint which is adapted to be connected in a well tubing in a well for opening and closing an electrically operated safety valve. The coil includes an electrical supply connection adapted to be connected to an electrical control line extending to the well surface for supplying power to the solenoid coil. A measuring sensor having an input and an output is provided with the input connected to the electrical supply connection of the solenoid coil for receiving electrical power and the output is connected to the electrical supply connection for supplying an output signal proportional to the measurement sensed by the sensor. The output signal is of a type distinguishable from the electrical supply to the solenoid coil. A signal processor is adapted to be positioned at the well surface and connected to the electrical supply connection for receiving the sensor output.

Still a further object of the present invention is wherein the sensor is connected in parallel with at least a portion of the solenoid coil for receiving a supply current for operating the sensor.

Yet still a further object of the present invention is wherein a downhole interface is connected between the input of the sensor and the supply connection and includes a current regulator for regulating the current through the sensor even though the current to the solenoid coil is varied for operating the safety valve.

Yet a still further object of the present invention is wherein the output signal is a variable frequency and the signal processor includes a frequency counter for measuring the output from the sensor.

Still a further object of the present invention is the combination of a subsurface electrically operated solenoid safety valve and measuring sensor including an electrical subsurface safety valve positioned in a well tubing in a well in which the valve includes a solenoid coil to which one level of direct current is applied for opening the valve and a second lower level of direct current is applied for holding the valve in the open position. A control line is provided extending from the coil to the well surface for applying direct current to the coil from the surface for operating the safety valve. A measuring sensor is positioned in the well outside of the safety valve for measuring a physical property of the well. The sensor has an input and an output and the input is connected to the control line for receiving electrical power and the output is connected to the control line for supplying an output signal proportional to the measurement of the physical property. The output signal is distinguishable from the direct current electrical supply to the solenoid coil. A signal processor at the well surface is connected to the control line for receiving the sensor output.

Other and further objects, features and advantages will be apparent from the following description of a presently preferred embodiment of the invention, given for the purpose of disclosure and taken in conjunction with the accompanying drawing.

BRIEF DESCRIPTION OF THE PREFERRED EMBODIMENT

Figure 1:
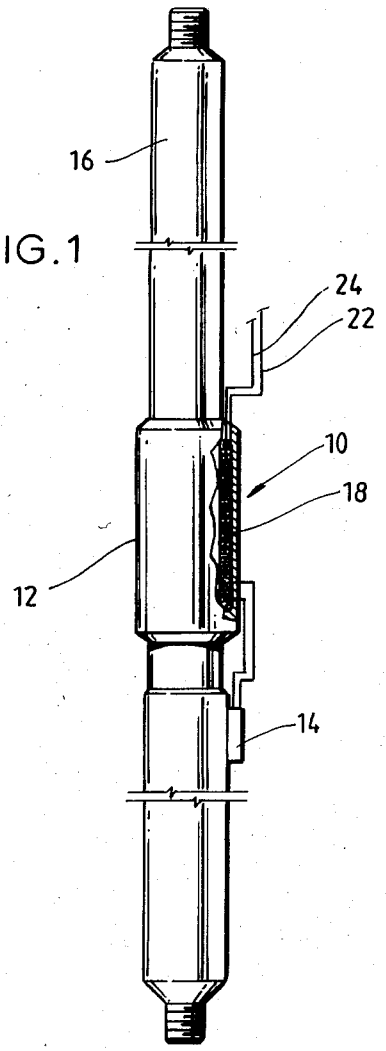
FIG. 1 is an elevational view, partly in cross section, illustrating the downhole installation of the present invention.

Referring now to the drawings, and particularly to FIG. 1, the reference numeral 10 generally indicates the combination of a subsurface electrically operated solenoid safety valve 12 and one or more measuring sensors 14 which are connected to a well tubing 16 which extends from the well surface to a producing zone in a well.

The solenoid safety valve 12 may be of any suitable type and may be either a tubing retrievable type or a wire line retrievable type. In either type, a solenoid coil 18 is connected about the exterior of the safety valve in a joint adapted to be connected in the well tubing 16. One suitable type of safety valve is more fully disclosed in copending patent application Ser. No. 06/697,544, filed Feb. 1, 1985, entitled "Solenoid Actuated Well Safety Valve", which is incorporated herein by reference, in which two current levels are provided with the first high current level being provided to actuate the safety valve to the open position and then a second lower continuous current level is provided to retain the valve in the open position.

Figure 2:
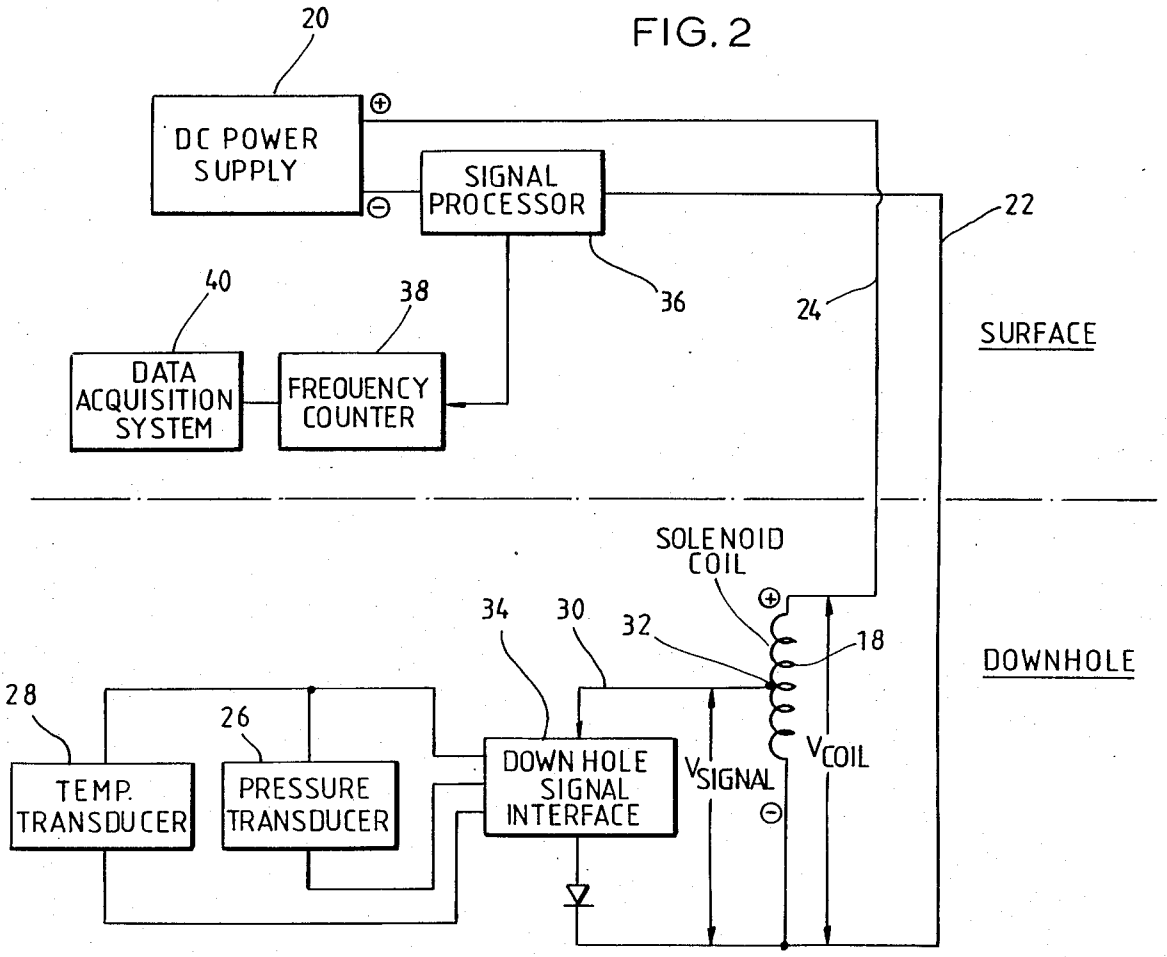
FIG. 2 is an electrical schematic of the electrical connections of the present invention.

Referring now to FIGS. 1 and 2, an electrical DC power supply 20 is provided at the well surface to supply direct current power through control lines 22 and 24 extending from the well surface to the solenoid coil 18 for actuating the safety valve 12. Preferably, the control line consists of the two conductors 22 and 24 so that the current is floating with respect to ground although if desired the tubing 16 could be utilized to act as one of the conductors.

The sensor 14 includes at least one measurement sensor such as a pressure transducer 26 which is mounted outside of the well tubing 16 in the sensor 14 for measuring the pressure in the well bore. Examples of other types of sensors which may be used are a temperature transducer 28, strain gauges, etc. The transducers 26 and 28 have the ability to produce an electrical output proportional to the physical property to be measured. The output of the sensors or transducers 26 and 28 are connected to the lines 22 and 24 and may be of several forms such as voltage, current or frequency which is scaled to the measured property. The output of the sensors or transducers 26 and 28 are fed into the downhole signal interface 34. The downhole signal interface will perform a signal conversion in the case of a sensor output which is indistinguishable from the direct current power signal for the solenoid valve. Such would be the case with a direct current or voltage signal proportional to the measured property. The output from the downhole signal interface will therefore be a form distinguishable from the solenoid valve power signal such as an alternating current frequency. Preferably, the output from the transducers 26 and 28 are an alternating current frequency which is scaled within a frequency band width in which the signal frequency is proportional to the measured property. One type of suitable pressure transducer is the Hewlett Packard Model 2813D Quartz Pressure Set. In the case of such a frequency output from the transducers the function of the downhole signal interface will be only management of the transmission of the signal. Other suitable conventional measuring sensors may be used.

Preferably, the input of the sensors 26 and 28 receives operating power from the control lines 22 and 24 preferably by being in parallel with at least a portion of the solenoid coil 18. For example only, assuming that the voltage across the coil is 100 volts, the input 30 to the sensors 26 and 28 is tapped to a point 32 on the solenoid coil 18 to provide a voltage in the range of 14 to 30 volts. By connecting the sensors 26 and 28 in parallel with a portion of the solenoid coil 18 the use of other downhole electrical components for obtaining the correct supply voltage to the sensors 26 and 28 is avoided.

As previously mentioned, when actuating the safety valve 12, a higher current level is supplied by the DC power supply 20 to the coil 18 to open the safety valve 12. Thereafter, the solenoid valve 12 remains open with a lower current level. The sensors 26 and 28 are designed to operate from the lower continuous DC current level. Therefore, a further function of the downhole signal interface 34 is to sense the current level and upon sensing the high current used to actuate the safety valve 12, the interface 34 will protect the sensors 26 and 28 from high voltage. Therefore, the interface 34 includes a current regulator to protect the sensors 26 and 28. In the case of the example given the pressure transducer 26 input will be provided with a current of approximately 14 milliamps direct current.

The outputs from the downhole signal interface 34 are connected to the control lines 22 and 24 and are transmitted to the surface where they are connected to a signal processor 36. In the case where the output is a variable frequency, the processor 36 may be a Hewlett Packard Model 2816A which processes the variable frequency and outputs this frequency as a nominal square wave to a conventional frequency counter 38. The frequency output from the counter 38 is thus a measure of the physical property, such as pressure or temperature from the sensors 26 and 28, which has been measured in the well. The output from the frequency counter 38 is then transmitted to a data acquisition system 40 which may be a display, recorder or transmitter for receiving the measured output from the sensors 26 and 28.

The monitoring of more than one sensor may be accomplished by having different frequency spectrums from the different sensors 26 and 28 to uniquely identify the output from the different sensors 26 and 28 or as an alternative the signal interface 34 may use a multiplexer to poll the different transducers 26 and 28.

The present invention therefore allows the operation of both the solenoid safety valve 12 and the sensors 26 and 28 to be operated, controlled, and receive data over the single control circuit consisting of the lines 22 and 24.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. The combination of a subsurface electrically operated solenoid safety valve and measuring sensor comprising, an electrical solenoid coil of a subsurface safety valve connected about a well tubing joint adapted to be connected in a well tubing in a well for opening and closing an electrically operated safety valve, said coil including an electrical supply connection adapted to be connected to an electrical control line extending to the well surface for supplying power to the solenoid coil from the well surface, a measuring sensor having an input and an output, said input connected to the electrical supply connection of the solenoid coil for receiving electrical power, said output connected to the electrical supply connection for supplying an output signal proportional to the measurement sensed by the sensor, said output signal being distinguishable from the electrical supply to the solenoid coil, and a signal processor adapted to be positioned at the well surface and connected to the electrical supply connection for receiving the sensor output.

2. The apparatus of claim 1 wherein said sensor is connected in parallel with at least a portion of the solenoid coil.

3. The apparatus of claim 1 including, a downhole interface connected between the input of the sensor and the supply connection and including a current regulator.

4. The apparatus of claim 1 including a frequency counter connected to the signal processor and wherein the output signal is a variable frequency.

5. The combination of a subsurface electrically operated solenoid safety valve and measuring sensor comprising, an electrical subsurface safety valve positioned in a well tubing in a well, said valve including a solenoid coil to which one level of direct current is applied for opening the valve and a second lower level of direct current is applied for holding the valve in the open position, a control line extending from the coil to the well surface for applying direct current to the coil for operating the safety valve, a measuring sensor positioned in the well outside of the safety valve for measuring a physical property of the well, said sensor having an input and an output, said input connected to the control line for receiving electrical power, said output connected to the control line for supplying an output signal proportional to the measurement of the physical property, said output signal being distinguishable from the direct current electrical supply to the solenoid coil, and a signal processor positioned at the well surface is connected to the control line for receiving the sensor output.

6. The apparatus of claim 5 wherein said sensor is connected in parallel with at least a portion of the solenoid coil.

7. The apparatus of claim 6 including, a downhole interface connected between the input of the sensor and the control line and including a current regulator.

8. The apparatus of claim 7 including a frequency counter connected to the signal processor and wherein the output signal is a variable frequency.

9. The apparatus of claim 7 including, a signal conditioner in the downhole interface which will transform a direct current or direct voltage sensor output into a frequency output.

* * * * *